US009968144B2

(12) United States Patent
McPhail

(10) Patent No.: US 9,968,144 B2
(45) Date of Patent: May 15, 2018

(54) PROTECTIVE GLOVE WITH A FLOATING CUFF

(71) Applicant: Warrior Sports, Inc., Warren, MI (US)

(72) Inventor: Matthew W. McPhail, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 326 days.

(21) Appl. No.: 14/989,418

(22) Filed: Jan. 6, 2016

(65) Prior Publication Data

US 2016/0198779 A1 Jul. 14, 2016

Related U.S. Application Data

(60) Provisional application No. 62/102,138, filed on Jan. 12, 2015.

(51) Int. Cl.
*A41D 19/00* (2006.01)
*A63B 71/14* (2006.01)

(52) U.S. Cl.
CPC ..... *A41D 19/0044* (2013.01); *A63B 71/141* (2013.01)

(58) Field of Classification Search
CPC .. A41D 19/0044; A63B 71/141; A63B 71/143
See application file for complete search history.

(56) References Cited

U.S. PATENT DOCUMENTS

| | | | | |
|---|---|---|---|---|
| 923,256 | A | 6/1909 | Fletcher | |
| 4,497,073 | A | 2/1985 | Deutsch | |
| 4,677,698 | A * | 7/1987 | Angas | A63B 71/143 2/16 |
| 6,990,690 | B2 * | 1/2006 | Gait | A63B 71/148 2/161.1 |
| 7,458,107 | B2 * | 12/2008 | Desjardins | A41D 13/088 2/161.1 |
| 7,900,275 | B2 | 3/2011 | Morrow et al. | |
| 8,060,949 | B2 | 11/2011 | Carcaterra et al. | |
| 8,769,720 | B2 | 7/2014 | Aoki et al. | |
| 2009/0019613 | A1 * | 1/2009 | Carcaterra | A63B 71/143 2/16 |
| 2014/0143924 | A1 * | 5/2014 | Rusakov | A63B 71/143 2/16 |

* cited by examiner

*Primary Examiner* — Katherine Moran

(74) *Attorney, Agent, or Firm* — Warner Norcross and Judd, LLP

(57) ABSTRACT

A protective glove includes a floating cuff joined with a hand portion, the floating cuff configured to encircle a wearer's wrist and/or forearm, the floating cuff being the only layer of protection over a posterior of the wearer's wrist/forearm. The glove can include a first wing panel and a second wing panel, distal from one another, and extending rearward from a rearward edge of the hand portion. The floating cuff can include a primary cuff portion disposed between the first and second wing panels, with the exteriors of all of the primary cuff portion, first and second wing panels lying at a common level and/or laying generally flush with one another. The floating cuff provides enhanced flexibility to the glove, particularly during wrist extension, and can be configured to ride up a wearer's forearm during such wrist extension to provide increased coverage of the forearm.

16 Claims, 13 Drawing Sheets

PROTECTIVE GLOVE WITH A FLOATING CUFF

BACKGROUND OF THE INVENTION

The present invention relates to protective equipment, and more particularly to a protective glove having a floating cuff that provides enhanced flexibility and protection, and that promotes ergonomic movement.

In many contact sports, such as lacrosse and hockey, sticks are elements of the game. A player's hands, wrists, and lower arms are vulnerable to minor and sometimes significant injury when being checked by another player's stick. For this reason, players typically wear padded gloves to protect their hands, wrists and lower arms during play of the sport.

An issue with most padded sports gloves, however, is that they can impede natural movement of the hand and wrist, thereby making stick control more difficult, and in some cases not as fine-tuned. This movement impairment is particularly prevalent in some gloves having wrist "tri-cuffs." Tri-cuffs usually include three pads, with two pads overlapping and covering a third pad. These three pads collectively overlay the upper part of a user's wrist, and that are attached directly to the back hand of the glove. These tri-cuffs provide decent mobility during wrist flexion and extension; however, because the tri-cuff moves with the back of the glove, it might not provide maximum protection to a wearer's wrist when the wrist is flexed forward. In such a case, the exposed wrist can be struck by a stick.

In an effort to improve the tri-cuff, and glove protection, in general, some manufacturers provide a floating cuff that is fitted under the tri-cuff. This combined tri-cuff and floating cuff system is illustrated in U.S. Pat. No. 7,900,275 to Morrow, which is hereby incorporated by reference in its entirety. While this tri-cuff and floating subcuff system provide more protection to a wearer's wrist, particularly when the wrist is flexed forward toward the forearm, the floating subcuff effectively doubles the padding in the wrist when the wrist is neutral, and when it is extended. The floating cuff abuts and engages the underside of the tri-cuff, which covers it and the user's wrist. In turn, the floating subcuff can in some cases further reduce rearward wrist extension. While providing enhanced protection, this can lead to reduced wrist mobility and can impair efficient stick handling in some cases.

SUMMARY OF THE INVENTION

The current embodiments provide a glove including a floating cuff that yields increased protection to the wrist of a wearer without substantially impairing the wearer's wrist movement.

In one embodiment, the floating cuff is configured to encircle a wearer's wrist and/or forearm, and is the only layer of protection over a posterior of the wearer's wrist and/or forearm. Thus, there are no additional layers of protection over the posterior of the wearer's wrist and/or forearm, particularly any that might bind against or interfere with the movement of the floating cuff relative to the hand portion of the glove.

In another embodiment, the glove can include a first wing panel and a second wing panel, distal from one another, and extending rearward from a rearward edge of the hand portion. The first and second wing panels can be disposed opposite one another, across a longitudinal axis of the glove, on respective lateral and medial sides of the glove.

In still another embodiment, the floating cuff can include a primary cuff portion disposed between the first and second wing panels, with the exteriors of all the primary cuff portion, first wing panel and second wing panel lying at a common level and/or laying generally flush with one another.

In yet another embodiment, the floating cuff can include a secondary cuff portion joined with the primary cuff portion. The secondary cuff portion, unlike the primary cuff portion, can be overlapped with the first wing panel and/or second wing panel. Thus, in the regions of the first wing panel and second wing panel, the wrist can be protected by a double protective layer, including the secondary cuff portion and the respective wing panels.

In even another embodiment, the floating cuff can be disposed in an opening defined by the hand portion, an edge of the first wing panel, and an edge of the second wing panel. The floating cuff can span from one wing panel edge to the other, substantially filling the opening. Optionally, the floating cuff can be on a similar level as the wing panels, rather than being under the wing panels.

The glove of the current embodiments, with its floating cuff, provides enhanced flexibility to a wearer of the glove, particularly during wrist extension, and can be configured to ride up a wearer's forearm during such wrist extension to provide increased coverage of the forearm. In addition, the floating cuff can provide a minimal amount of additional padding to the wrist, yet still provide enhanced protection, flexibility and mobility to the wrist.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A protective glove in accordance with a current embodiment is illustrated in FIGS. 1-12 and generally designated 10. While the drawings illustrate a left hand glove, the current embodiments can be incorporated into a right hand glove, which is generally a mirrored version of the left hand glove. Additionally, the glove 10 as illustrated is designed for use in the game of lacrosse, however, the glove can be used in a variety of other sports or other activities, such as ice or field hockey, or any other activity where a user may move their hand about their wrist, optionally in the process of manipulating a game stick or other grasped item. For example, the glove can be incorporated into protective gear used by law enforcement, military or in other occupational or commercial endeavors.

Figure 6:
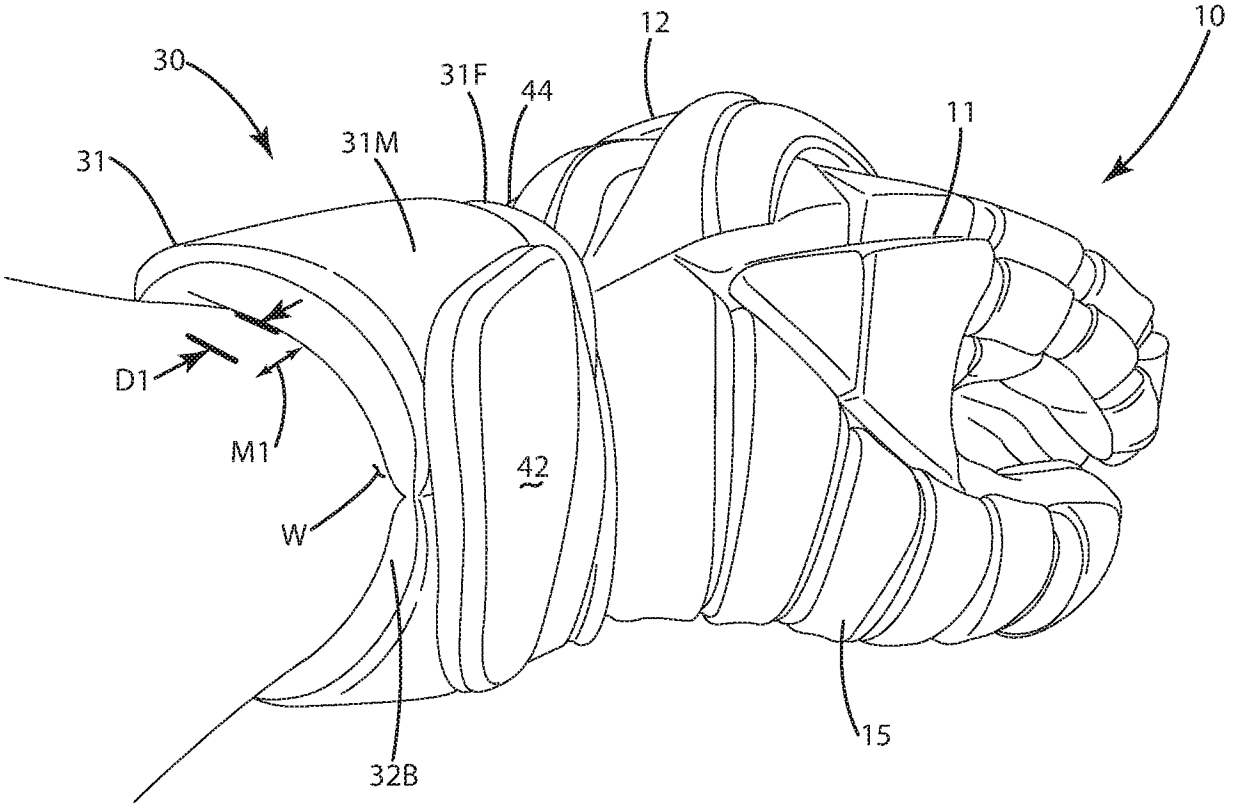
FIG. 6 is a rear perspective view of the floating cuff and glove when the glove is in the neutral mode.
Figure 8:
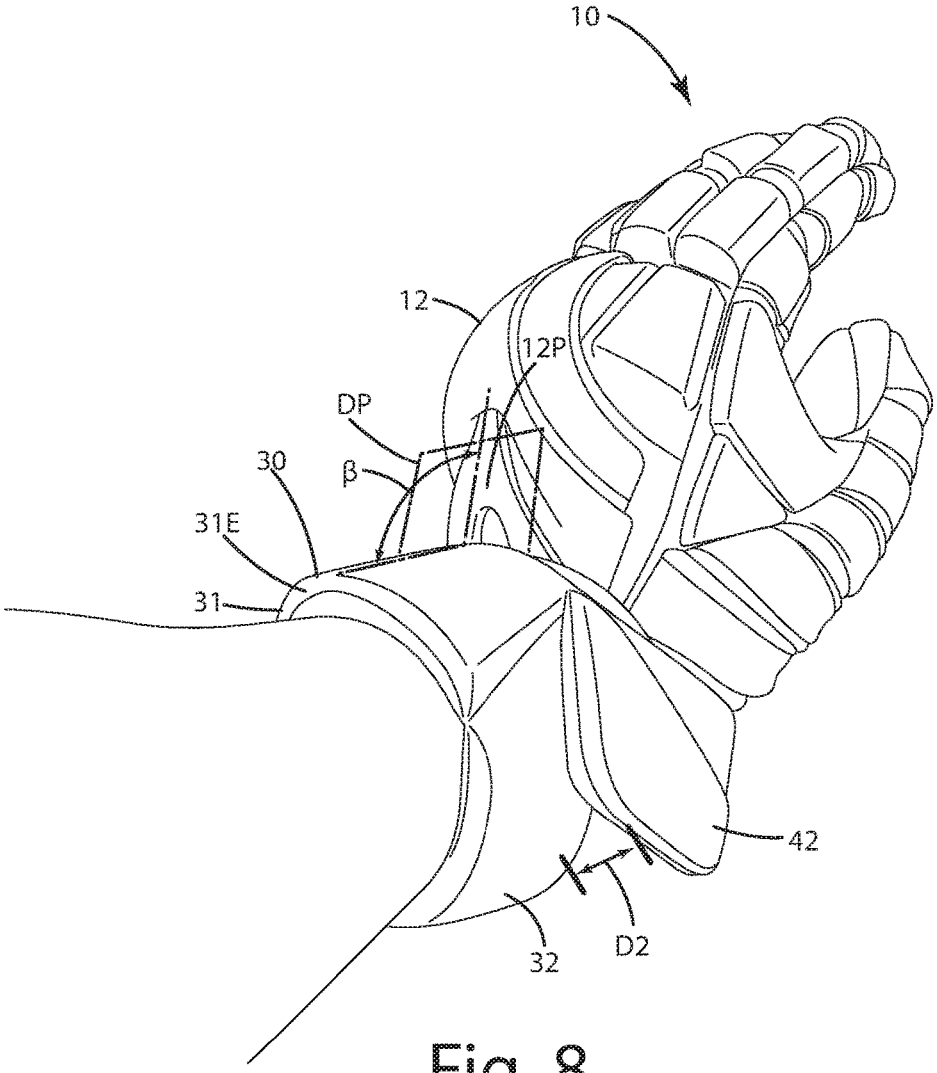
FIG. 8 is a rear perspective view of the floating cuff and glove when the glove is in the extended mode.
Figure 10:
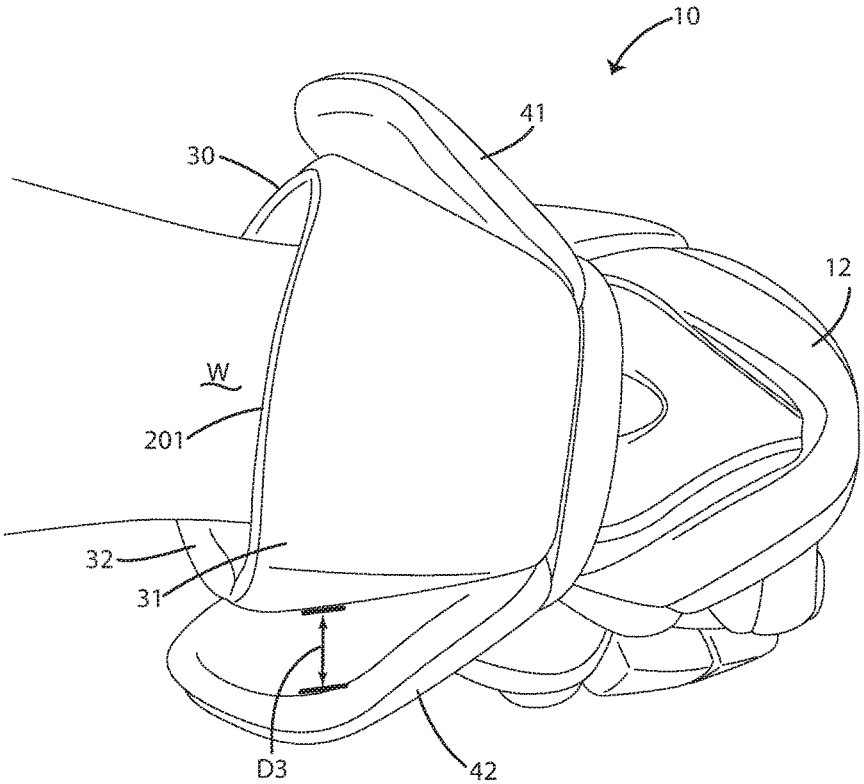
FIG. 10 is an upper perspective view of the floating cuff and glove when the glove is in the flexed mode.

The description of the glove 10 can be aided by brief discussion anatomy and movement of a hand, wrist and forearm. Generally, as used herein, the wrist can refer to the wrist and/or the lower forearm. The wrist can include a posterior side, a lateral side, a medial side and an anterior side, as defined by conventional anatomy. The hand itself of a wearer can generally include fingers and a thumb. The hand can be delineated into a dorsal side, that is, the back of the hand, a palmar side, that is, the front or palm of the hand, an ulnar side, which corresponds to the side of the hand near which the ulna bone in the forearm is disposed, and a radial side, which corresponds to the side of the hand near which the radius bone in the forearm is disposed. Generally, the wearer's wrist can flex and extend to and from a neutral position. Examples of a wrist in a neutral mode are shown in FIG. 6, while an extended mode of the wrist is shown in FIG. 8, and a flexed mode of the glove is illustrated in FIG. 10. Varying degrees of the neutral mode, the flexed mode and the extended mode are possible.

Figure 1:
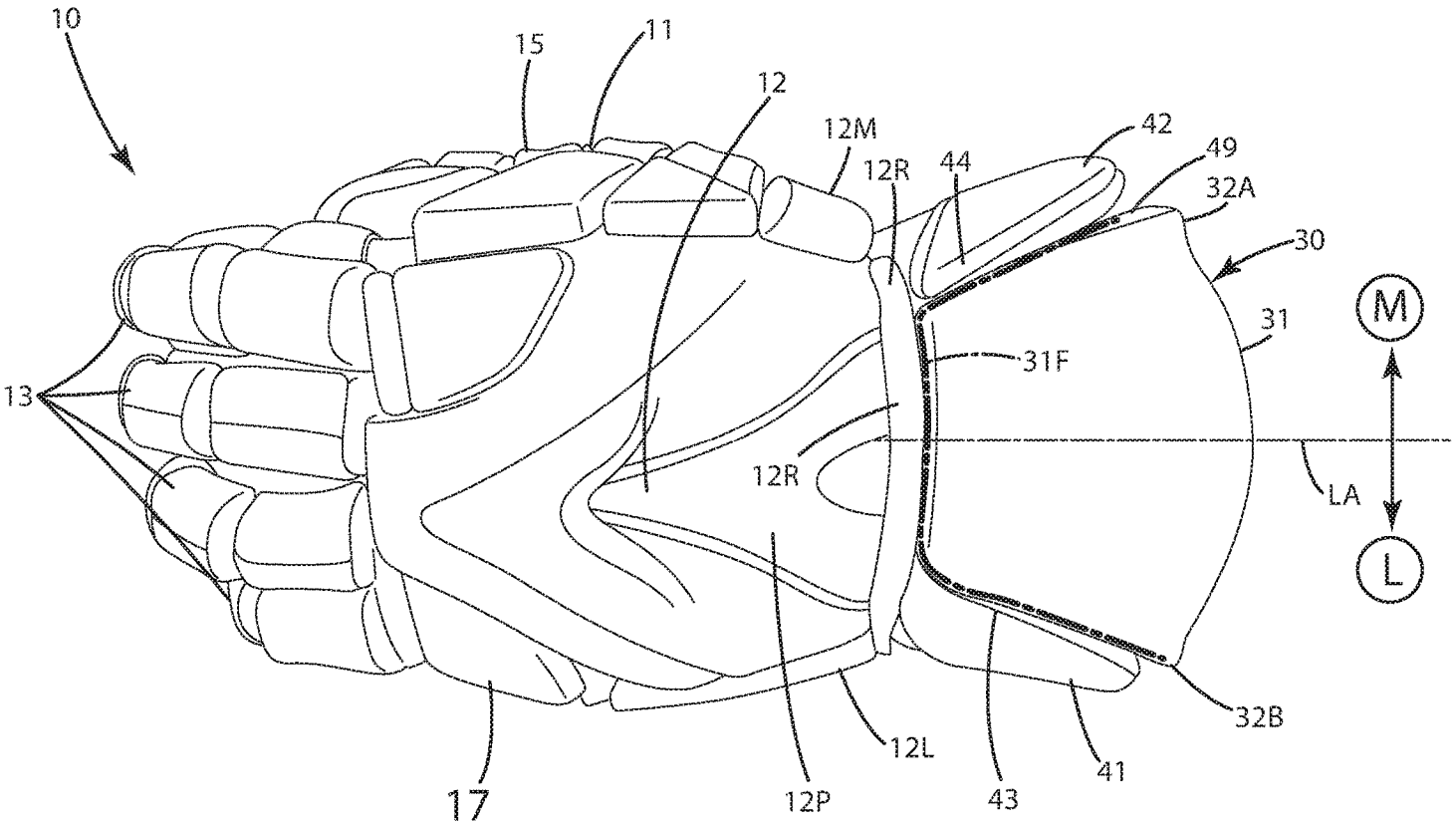
FIG. 1 is a top view of a dorsal side of a glove including a floating cuff according to a current embodiment.
Figure 2:
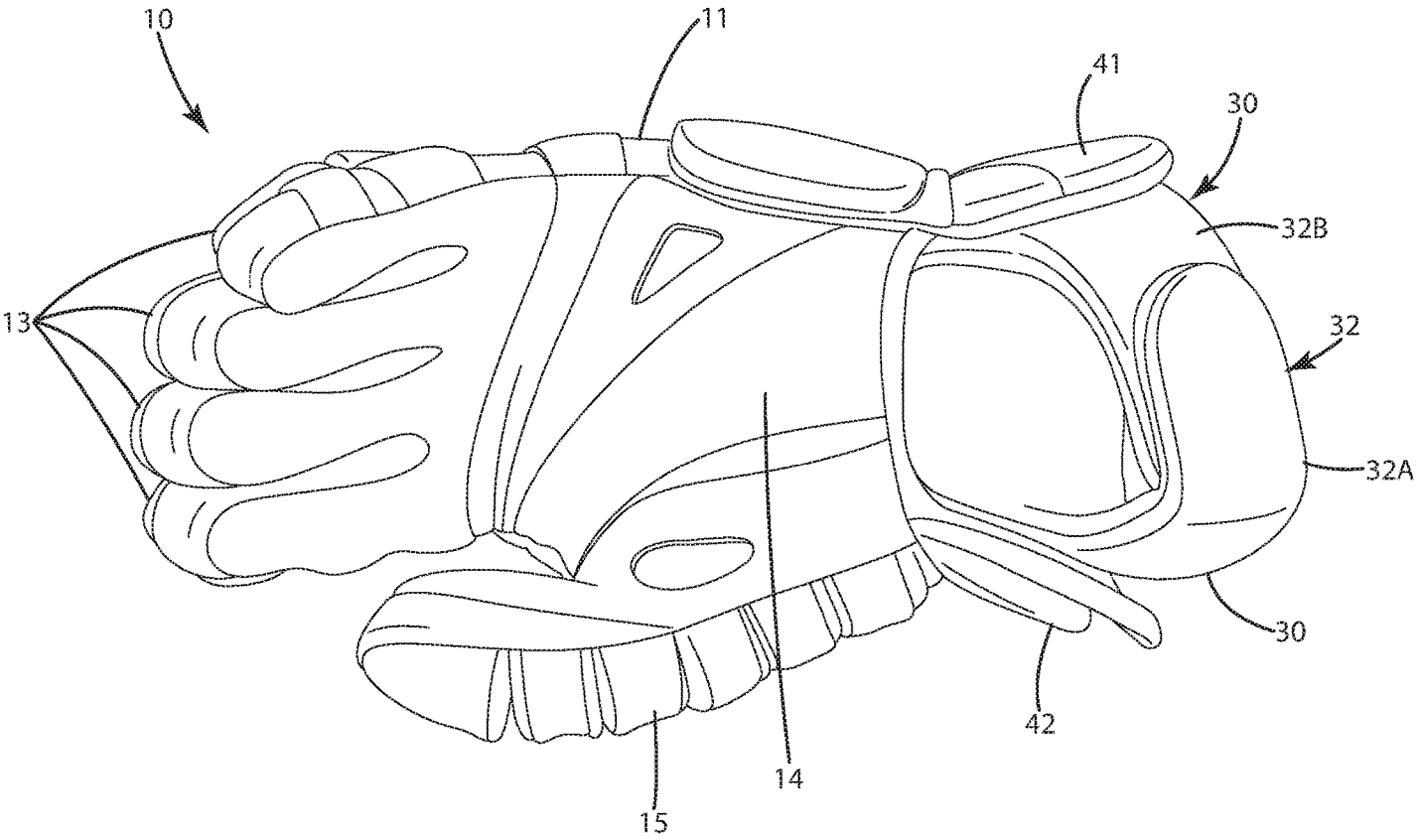
FIG. 2 is a bottom view of a palmar side of the glove.

As shown in FIGS. 1 and 2, the protective glove 10 can include a hand portion 11 which can be configured to enclose different portions of the hand, such as the palmar side, dorsal side, ulnar side, radial side and/or fingers of the wearer when the glove is applied to the hand. The protective glove 10 can include a back portion 12 and a palm portion 14, between which an interior space adapted to receive a wearer's hand is defined. The back portion 12 can be configured so that it is generally adjacent a dorsal side of the wearer's hand when the hand is inserted into the glove, while the palmar portion 14 of the glove can be adjacent a palmar side of the hand when the hand is inserted into the glove. The back portion 12 and its various components can generally be referred to as the hand dorsal portion of the glove.

The hand dorsal portion 12 optionally can include multiple protective elements 17, which optionally can be in the form of padded portions secured thereto that provide padding and protection to a wearer's hand. The protective portions can be constructed of one or more layers of foam, polyurethane, polymers or other suitable materials. These individual protective portions can be covered with a covering such as leather, plastic or other material to protect any internal foam or other padding therein. The multiple protective portions 17 can be sewn to a protective outer material such as a cloth, spandex or the like. Each of the protective portions 17 can define one or more flex lines there between, which allow the glove, and in particular the hand dorsal portion, to move as the wearer's hand moves to provide a better fit and comfort during play. Flex lines can take on a variety of different configurations and placements as desired. Further optionally, the dorsal portion or other portions of the hand portion 11 can define one or more vents or openings. These vents or openings can enable air to circulate freely into an out from the wearer's hand thereby providing a cooling effect to improve comfort during extended periods of play. In addition, if desired, the hand portion 11 can include an internal liner that itself can be removable so that the liner can be easily dried after play.

As illustrated in FIG. 1, the backhand of the dorsal portion 12 of the hand portion 11 optionally can be outfitted with a particular type of padding that can reduce hyperextension of the wrist. Such a construction is described in U.S. Pat. No. 8,769,720 to Aoki, entitle "Lacrosse Glove," which is hereby incorporated by reference in its entirety.

The hand portion 12 also can include optional finger portions 13 which can correspond to the number of fingers on a user's hand. The number of finger portions can vary depending on the particular sport and/or activity. In addition, although shown with a thumb portion 15, which generally encloses or houses a thumb, the glove can be void of this thumb portion in certain applications.

The glove 10 optionally defines a longitudinal axis LA which is best shown in FIG. 1. The longitudinal axis LA can bisect the glove 10 down its center. On one side of the longitudinal axis LA is a medial side M, which can correspond to a medial side of the wearer's wrist when the glove is worn by the wearer. Opposite the medial side is a lateral side L, which can correspond to a lateral side of a wearer's wrist.

Figure 4:
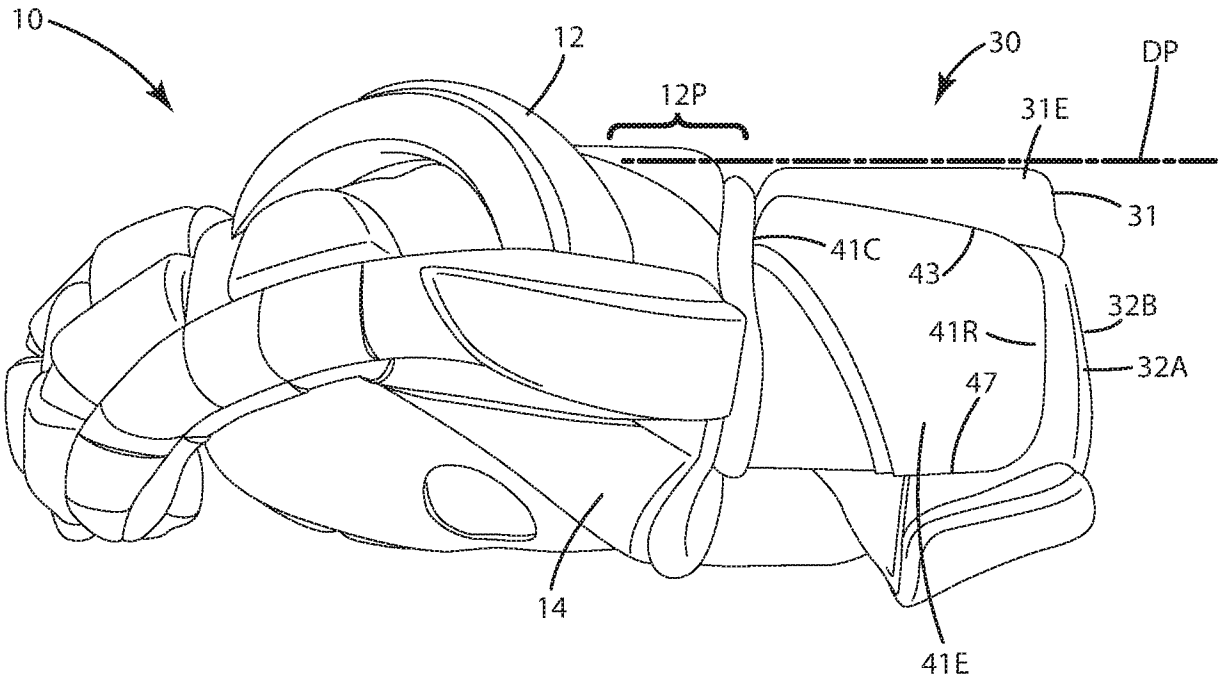
FIG. 4 is side view of a lateral side of the glove, when the glove is in the neutral mode.

As shown in FIG. 4, the hand dorsal portion 12 can include or define a dorsal plane DP as illustrated there. This dorsal plane DP can be taken as a tangent line and/or an extension line of the part 12P of the dorsal hand portion 12 that is adjacent the exterior surface 31E of the floating cuff 30 and/or the primary cuff panel 31. Optionally, the exterior surface 31E of the floating cuff and/or primary cuff panel can lay substantially in and/or be parallel with the dorsal plane DP. As illustrated in FIG. 4, the dorsal plane DP need not be aligned with the uppermost surface of the dorsal portion 12 in the hand. It can be a plane defined by three or more points in the part 12P of the hand dorsal portion 12 adjacent the floating cuff 30.

Referring to FIGS. 1-6, the hand portion 11 is joined with a floating cuff 30. As shown in FIG. 1, the hand portion 12 can define a rearward edge 12R. This hand portion rearward edge 12R can generally extend and/or circumferentiate the wearer's hand and/or wrist when the glove is worn. The rearward edge 12R can form portions of different parts of the hand portion 12. For example, the rearward edge 12R can include the dorsal hand portion of the glove, the palmar hand portion of the glove, as well as lateral and medial portions 12M and 12L of the glove.

As shown in FIG. 1, the rearward edge 12R of the hand dorsal portion can be joined directly with a forward edge 31F of the floating cuff 30 and in particular, the forward edge of the primary cuff panel 31.

With reference to FIGS. 1-4, the glove 10 can include first 41 and second 42 wing panels joined with the hand portion 11. These panels can be joined with the hand portion rearward edge 12R of and in particular, portions of the rearward edge that extend to the lateral 12L and medial 12M parts of the glove 10. The first and second wing panels can be similar in size, connection and dimension. The first wing panel 41 can be disposed on a lateral side L of the glove, while the second wing panel can be disposed on the medial side M of the glove, distal from the first wing panel. The wing panels optionally can be unattached to one another, and only attached to the hand portion, for example, the rearward edge 12R.

Optionally, the second wing panel 42 can be dimensioned slightly larger than the first wing panel due to the placement of the second wing panel on the medial side M of the wrist. This location on the medial side M of the wrist, under the thumb, can generally be subject to increased number of slashes and/or hits by an opponent's stick, as that thumb side or medial side 12M of a glove more frequently faces upward than the lower side 12L of the glove during maneuvering of a game stick. In some cases, the second wing panel optionally can be 10%, 20%, 30%, 40%, 50% or greater in size than the first wing panel. In some cases, the first wing panel can be eliminated altogether. If desired, both wing panels can be absent from the glove.

Figure 5:
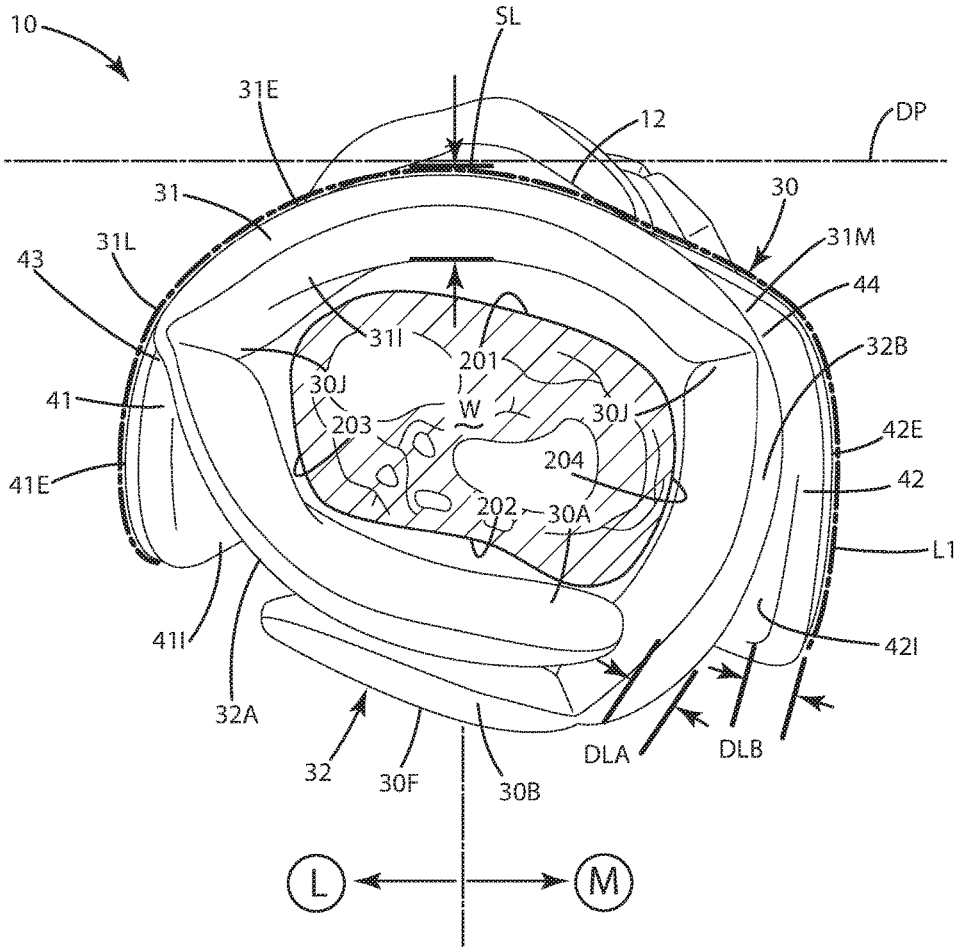
FIG. 5 is a rear view of the floating cuff and glove when the glove is in the neutral mode.

Generally, the components of the first wing panel 41 and second wing panel 42 can be similar and/or identical, and therefore only the first wing panel will be described in further detail here. To begin, the first wing panel again generally is disposed on the lateral side of the wrist L when the glove is donned by a wearer, while the second wing panel is disposed on the medial side of the wrist M when the glove is donned by the wearer. As shown in FIG. 5, the first wing panel can include a first wing panel exterior 41E and a first wing panel interior 41I. Likewise, the second wing panel 42 can include an exterior 42E and an interior 42I. The exteriors 41E and 42E of the respective panels can face outward and form a visible outer portion of the wing panels, which is unconcealed by other elements of the glove. The interior 41I of the wing elements can face inward toward the wearer's wrist W as shown in FIG. 5. The respective interiors 41I and 42I can abut and/or engage the secondary cuff portion 32 of the floating cuff 30. For example, the interior 41I can face toward, and in some cases abut and/or engage, the lateral secondary cuff panel 32A of the secondary cuff portion 32. Likewise, the interior 42I of the second wing panel 42 can face toward, abut and/or engage the medial secondary cuff panel 32B of the secondary cuff portion 32. However, when the wrist is in a neutral mode, as shown in FIG. 5, these interior portions 41I and 42I do not engage, abut and/or contact the exterior 31E of the primary cuff panel 31. Of course, in some constructions, where the primary cuff panel 31 and secondary cuff portion 32 are a unitary tube-like padded structure, and it can be difficult to delineate between then primary cuff portion 31 and secondary cuff portion 32. Optionally, in such a construction, the respective interiors 41I and 42I can face toward, abut and/contact portions of the primary cuff portion 31.

Returning to FIGS. 4 and 5, the first wing panel 41 can include a first wing panel interior edge 43, and the second wing panel can include a second wing panel interior edge 44. This interior edge 43 of the first wing panel can transition or project toward the hand portion 11 and more particularly the rearward edge 12R of the hand portion. Likewise, the interior edge 44 of the second wing panel can transition and can be directed toward the rearward edge 12R of the hand portion 11. Collectively, the rearward edge 12R, first wing panel interior edge 43 and second wing panel interior edge 44 can define a cuff opening 49 as shown in FIG. 1. The floating cuff 30 can be disposed and movable within this cuff opening 49. Optionally, the floating cuff 30 substantially fills the cuff opening, spanning from the first wing panel interior edge 43 to the second wing panel interior edge 44.

As shown in FIG. 5, the secondary cuff panel 32 and its secondary cuff panels 32A and 32B are joined with a primary cuff panel 31. The first wing panel can overlap the secondary cuff panel 32A and the second wing panel can overlap the secondary cuff panel 32B. Optionally, neither the first wing panel nor the second wing panel overlaps the primary cuff panel 31 of the floating cuff 30. In this manner, the primary cuff panel is free to move upward and bend, thereby facilitating mostly free extension of the wrist without the primary cuff panel engaging or being bound or impeded in its movements by the respective first wing panel 41 and/or second wing panel 42. In some cases, during the upward extension as further described below, these first and second wing panels will flex outward away from the longitudinal axis LA of the glove to permit the desired amount of extension and/or flexion of the wrist.

Optionally, the floating cuff 30 and in particular the floating cuff primary panel 31 extend between the first wing panel interior edge and the second wing panel interior edge. Further optionally, as illustrated, the first and second wing panels do not extend over or generally overlap the primary cuff panel 31, particularly when the floating cuff and/or glove are in the neutral mode and/or the extended mode. Even further optionally, no additional panels or padding extend over and/or conceal the primary cuff panel 31. Accordingly, the primary cuff panel can be the only protection panel or pad disposed over the dorsal side of the wearer's wrist.

Returning to FIG. 5 and the description of the in the respective first and second wing panels 41 and 42, these wing panels can extend rearward and terminate at a respective first panel rear edge 41R and a second panel rear edge 42R. These rear edges can form the limits or rearmost boundaries of the wing panels. Opposite the respective rear edges can be a connecting edge 41C of the first wing panel and a second connecting edge 42C of the second wing panel 42. These connecting edges can be bound, stitched, fused, welded, glued or otherwise attached to the hand portion, for example the rearward edge 12R of the hand portion. These connecting edges 41C and 42C can be connected to the rearward edge 12R distal from one another and disposed primarily on the respective medial M and lateral L sides of the wrist.

As shown in FIGS. 1 and 5, the wing panels 41 and 42 can be connected at their connecting edges, and separated from one another approximately the width of the forward edge 31F of the primary cuff panel 31. In some cases, the forward edge 31F of the primary cuff panel 31 can be disposed across substantially all of the posterior side 201 of the wearer's wrist W, with only minor portions being overlapped by the respective first and second wing panels 41 and 42. Again, these first and second wing panels can be dedicated to primarily protecting the lateral side L and medial side M of the wrist respectively, without substantially extending upward and over the posterior 201 of the wearer's wrist W. Again, this is because the floating cuff 30 can offer substantial protection to the wrist alone and by itself, without the aid of other panels, pads or protective layers. Optionally, the floating cuff 30 can be configured to encircle and/or surround and/or circumferentiate at least the wearer's wrist, which again can be the wearer's wrist and/or forearm. The first wing panel and second wing panel are offset laterally from the floating cuff so that these elements do not cover the primary cuff panel.

As noted above, the floating cuff 30 can include a primary cuff panel 31 and a secondary cuff portion or panel 32. The secondary cuff portion or panel can be subdivided into a lateral panel 32A and a medial panel 32B. These panels can extend generally along and circumferentiate, or can be adjacent the lateral 203 and medial 204 sides of a wearer's wrist W. They also can extend over and overlap one another on the anterior 202 of the wearer's wrist W when the glove is donned.

The floating cuff 30, and in particular the secondary cuff portion 32, also can include a first end 30A and a second end 30B as shown in FIG. 5. These ends can be secured to one another with a fastening element 30F. This fastening element can be in the form of a hook and loop fastener, such as Velcro™, buttons, latches, strings or the like. Optionally, the first and second ends 30A and 30B can be releasably attached to one another via the fastening element 30F so that a user can detach the respective ends and/or secondary cuff panels from one another, place their wrist in the opening, and then re-secure the fastening element to join the ends 30A and 30B so that the glove is securely fastened to the wearer's hand. Further optionally, the fastening element 30F can be in the form of an elastic or stretchable band that joins the first and second ends 30A and 30B, or an elasticized portion of the floating cuff 30. The stretchable fastening element 30F in this construction can be elastic or stretchable enough to enable a user to slide their hand through the opening defined by the floating cuff 30 and into the glove, without detaching the ends.

Figure 3:
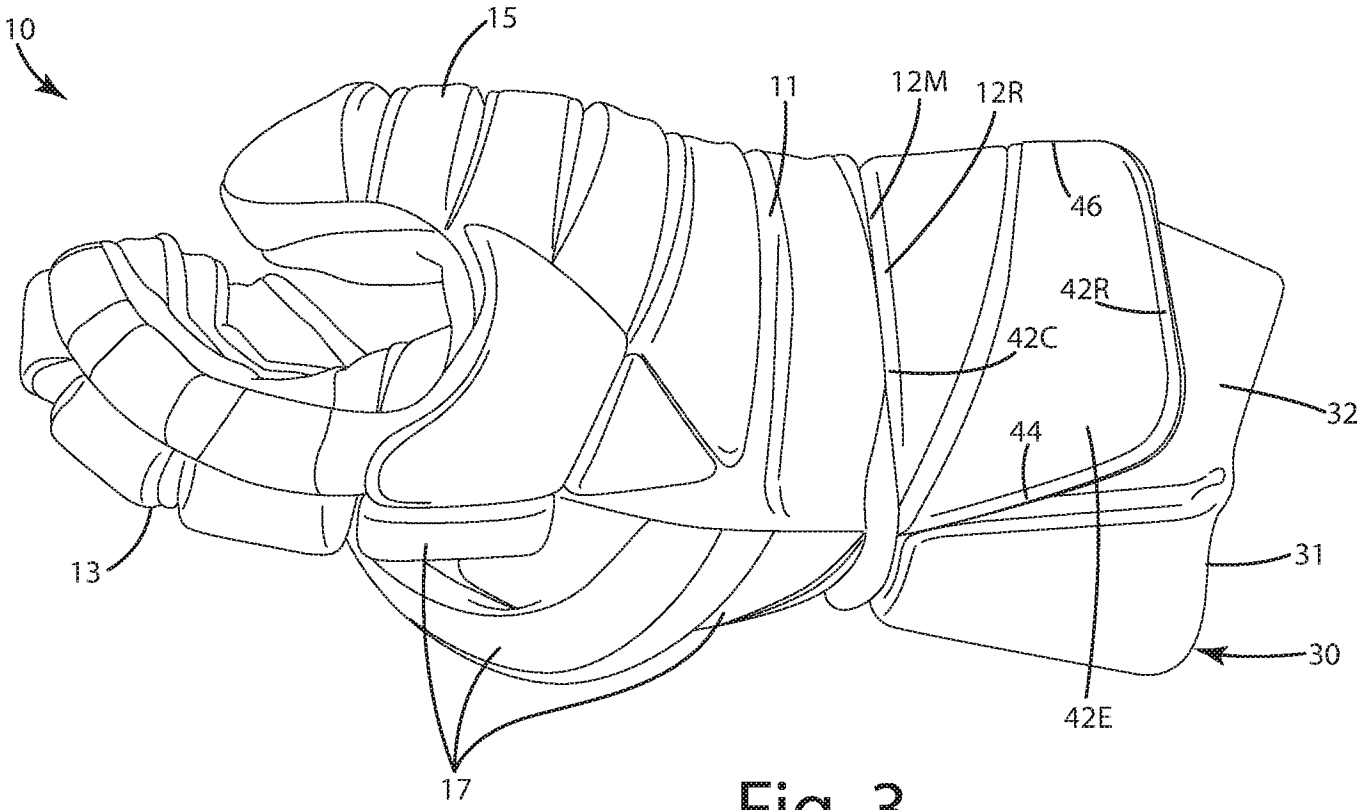
FIG. 3 is a side view of a medial side of the glove when the glove is in the neutral mode.

As shown in FIG. 5, the primary cuff panel 31 can be joined with the respective secondary cuff panels 32A and 32B at respective joints 30J. These joints optionally can be areas where the floating cuff 30 is void of internal padding and/or foam. These joints also can enable the secondary cuff panels 32A and 32B to project more inwardly toward the wearer's wrist W while enabling the primary cuff panel 31 to maintain a domed or arched configuration over the posterior 201 of the wearer's wrist W. With this construction as well, the primary cuff panel 31 can project upwardly, generally above the first and second wing panels as shown in FIGS. 3 and 5. With reference to these figures as well, the floating cuff 30 can form an uppermost or highest protective layer covering a superior side 201 of a wearer's wrist W. In both applications, the floating cuff can be uncovered or not overlapped above the posterior side 201 of the wearer's wrist W by any other additional padding layers or protective layers. Thus, the floating cuff 30 and the respective first cuff panel 31 effectively form a single layer of protection or protective layer over the posterior of the wearer's wrist. By this, it is meant that the first and second wing panels generally do not extend over or provide any substantial protection to the posterior of the wearer's wrist.

The secondary cuff portion 32 of the floating cuff 30 can extend adjacent and/or downwardly relative to the respective first wing panel and second wing panel as shown in FIG. 5. Generally, the secondary cuff portion extends over the medial side 204 of the wearer's wrist, between the second wing panel and the medial side of the wearer's wrist. Likewise, the secondary cuff portion extends over the lateral side 203 of the wearer's wrist W between the first wing panel 41 and the lateral side of the wearer's wrist. In this construction, the first wing panel 41 and the secondary cuff panel 32A can form a first double protective layer over a lateral side 203 of the wearer's wrist W. The second wing panel 42 and secondary cuff panel 32B on the opposite side can form a second double protective layer over a medial side 204 of the wearer's wrist. By double protective layer, it is meant that there are two separate and/or independent protective panels disposed over a particular body part—instead of just a single protective layer. This double protective layer contrasts the single protective layer provided by the floating cuff 30 and/or first cuff panel 31 over the posterior 201 of the wearer's wrist W. In some cases, the double protective layer can be comprised of different panels that are independently movable relative to one another and/or that slide over and engage one another during use of the glove 10. Optionally, in some cases, there may be triple protective layers, quadruple protective layers or other numbers of layers or particular components over a wearer's wrist and/or hand. As shown herein, however, there typically is only a double protective layer over the medial 204 and lateral 203 side of the wearer's wrist and a single protective layer in the form of a part of the floating cuff disposed over the posterior of the wearer's wrist.

The single layer of protection provided by the first cuff panel 31 and the floating cuff over the posterior 201 of the wearer's wrist W is further illustrated in FIG. 5. There, a single layer of protection SL is in the form of the first cuff panel 31 only being disposed over the posterior 201 of the wearer's wrist W. The double layer of protection DLA plus DLB is illustrated by the respective secondary cuff panel 32B and second wing panel 42 being disposed over the medial side 204 of the wearer's wrist W. Of course, this double layer of protection can be duplicated adjacent the medial side 203 of the wearer's wrist W with the first wing panel 41 and secondary cuff panel 32A. Optionally, the floating cuff 30 remains uncovered by any additional protective layer over the superior side 201 of the wearer's wrist W. Again, it can be the single protective layer disposed over that posterior side of the wrist.

As shown in FIGS. 1, 5 and 6, the floating cuff 30 can be constructed so that the first cuff panel 31 defines a forward edge 31F, a lateral edge 31L and a medial edge 31M. These edges can be generally contiguous with one another. The forward edge 31F of the first cuff panel 31 is configured to attach to the rearward edge 12R of the hand portion. This can be accomplished via a binding, stitching, glue, weld or other fasteners joining these components. Although the lateral and medial edges of the first cuff panel are described as "edges", the first cuff panel does not necessarily terminate at this component. Instead, it simply drops below and extends downward to the secondary cuff portion 32.

The respective edges of the floating cuff and in particular the floating cuff first cuff panel 31 and the first and second wing panels can be oriented so that they abut one another when the glove is in the neutral mode as shown in FIG. 6. In this mode, the exterior surfaces 41E of the first wing panel 41, the exterior surface 31E of the first cuff panel 31 and the second wing panel exterior surface 42E can be aligned and generally flush with one another to form a substantially continuous and only incidentally interrupted surface that encircles at least a portion of the wearer's wrist. As better shown in FIG. 5, these exterior surfaces form and are all generally disposed at the same level L1 around at least a portion of the wearer's wrist W. Thus, where the respective edges or portions of the wing panels abut or are adjacent the floating cuff and in particular the floating cuff first cuff panel 31, the exterior surfaces are generally flush with one another so that it almost appears that they are connected or at least extremely close to one another. When these components, that is, the wing panels and the floating cuff move during flexion and/or extension of the wrist, the respective panels move relative to one another as further described below to provide the desired mobility of the wrist W.

As mentioned above, the floating cuff 30 and the glove in general 10 are operable in a neutral mode, an extended mode and a flexed mode. These modes correspond to the neutral position of the wrist, the extended position of the wrist and the flexed position of the wrist. In the neutral mode shown in FIGS. 5 and 6, when the glove is on the wearer's hand, the floating cuff generally encircles the wearer's wrist W. The first cuff panel 31 is disposed on or over the posterior 201 of the wearer's wrist, while the lateral and medial secondary cuff panels 32A and 32B are disposed on the respective lateral 203 and medial 204 sides of the wrist W. In this configuration, the exteriors of the wing panels 41E and 42E are generally flush with, and contiguous within a same level L1 as the exterior 31E, of the first cuff panel 31. In addition, at least a portion of the exterior 31E of the first cuff panel 31 can lie within a dorsal plane DP of portion 12P of the hand dorsal portion 12. In this configuration, the first and second wing panels and the respective edges can lay below the dorsal plane DP by slight amount.

Figure 7:
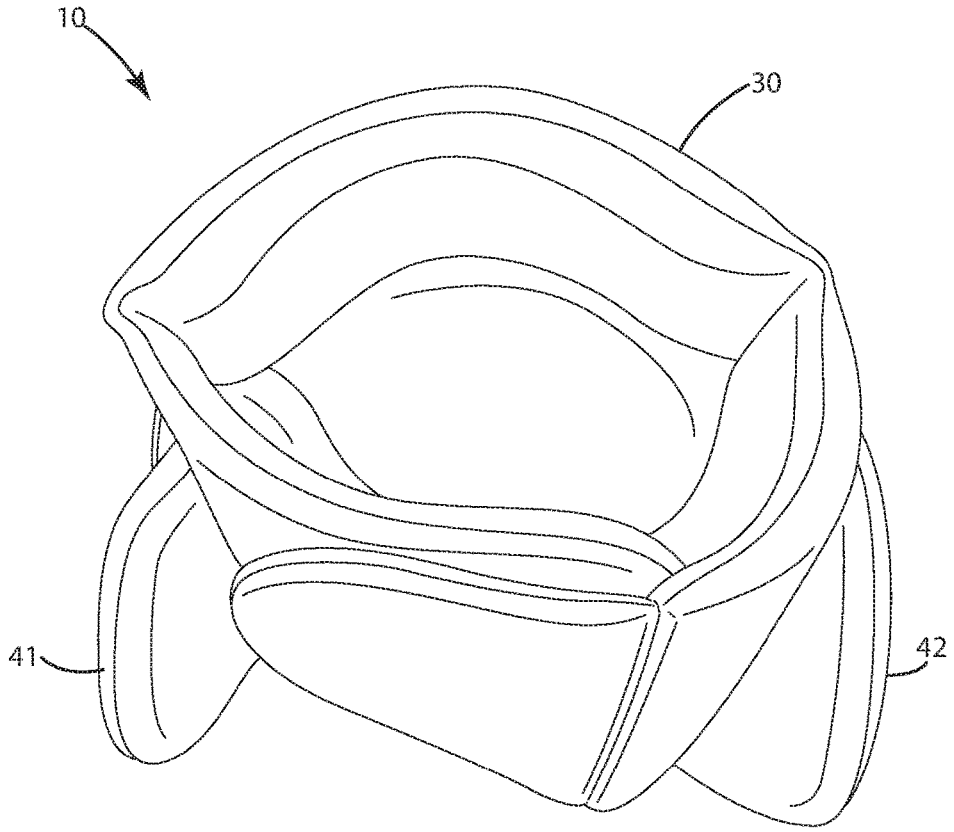
FIG. 7 is a rear view of the floating cuff and glove when the glove is in an extended mode.

The glove 10 can transition from a neutral mode shown in FIGS. 5 and 6 to an extended mode shown in FIGS. 7 and 8. There, the wrist is extended upward so that the hand moves upward as well. In this manner, the orientation of the hand relative to the wrist and forearm changes. The floating cuff 30, as mentioned above, encircles the wearer's wrist. Thus, when the hand moves to the extended position as shown in FIGS. 7 and 8, the floating cuff moves relative to the hand portion 12 of the glove. As an example, the exterior surface 31E of the first cuff panel 31 changes relative to the dorsal hand portion 12P where the dorsal plane DP is located. Thus, in this extended mode, the exterior surface 31E no longer lays within nor is substantially parallel to the dorsal plane DP. Instead, it is disposed at any angle β relative to the dorsal plane DP. In addition, because the wing panels 41 and 42 are disposed laterally, along the dorsal and medial sides of the secondary cuff portion 32, those wing panels do not interfere with the upward movement of the first cuff panel 31 or generally with the floating cuff in general. Thus, the floating cuff does not bind or push against any additional protective layers as it rotates upward toward the hand dorsal portion 12 in the extended mode.

Optionally, the floating cuff 30 can move a distance D1 up the wearer's wrist and/or forearm when transitioning from the neutral mode shown in FIG. 6 to the extended mode shown in FIG. 8. This distance D1 can be optionally about 0.25 to about 1.5 inches, further optionally about 0.5 inches to about 1 inch, depending on the profile of the wearer's wrist and/or forearm, and how tightly the floating cuff 30 encircles the wearer's wrist. Generally, the ability of the floating cuff to slide upward along the wearer's wrist and/or forearm provides additional protection. For example, with the floating cuff sliding farther up the wrist and forearm, more of the wrist and/or forearm are covered and protected. The wing panels also can exhibit some movement during transition of the wrist to the extended mode. For example, as shown in FIG. 8, the wing panel 42 can move or bend outward a distance D2 slightly away from the secondary cuff portion 32. This can enable the floating cuff 30 to easily glide from a neutral mode to the extended mode, without the wing panels interfering with that movement.

Figure 9:
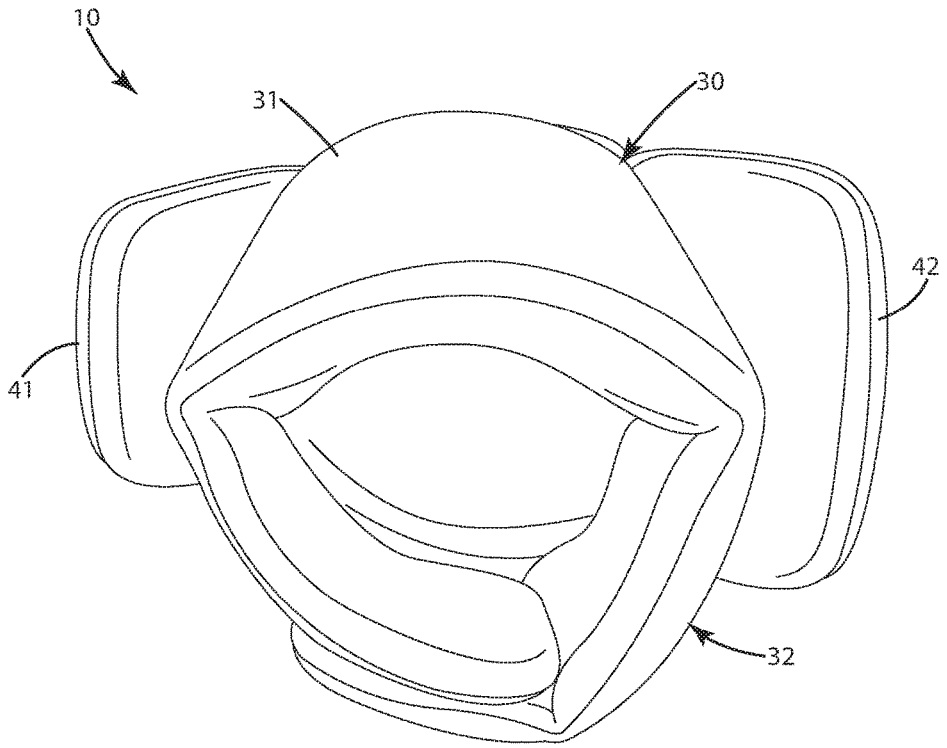
FIG. 9 is a rear view of the floating cuff and glove when the glove is in a flexed mode.
Figure 11:
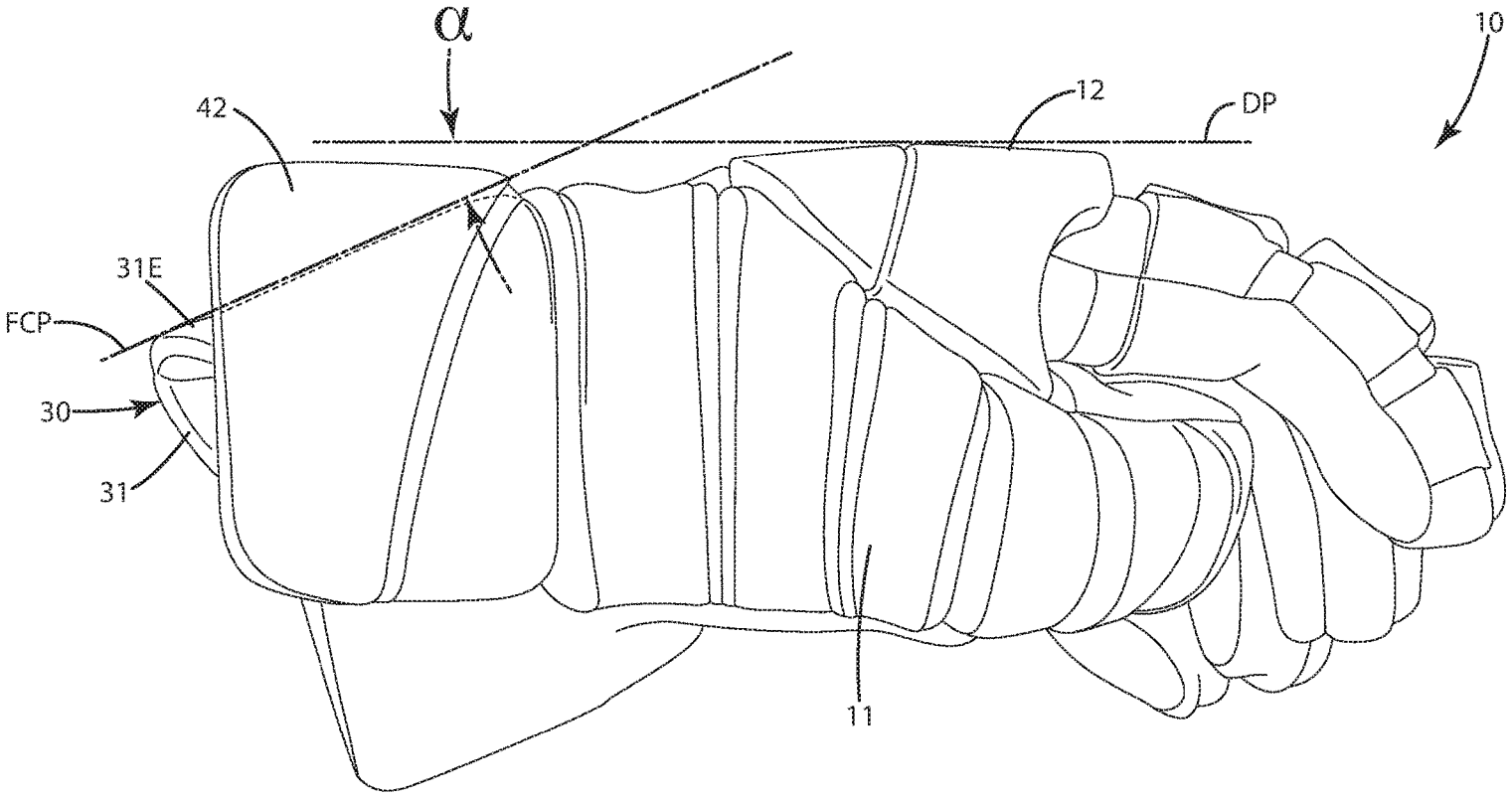
FIG. 11 is a medial side view of the floating cuff and glove when the glove is in the flexed mode.

The glove 10 also can transition from the neutral mode to the flex mode shown in FIGS. 9-11. As shown in FIG. 9, when the wrist flexes, the floating cuff 30 remains on the wearer's wrist, encircling it and protecting it, and in particular, the posterior 201 of the wearer's wrist. In this configuration, the first wing panel 41 and second wing panel 42 can flex or dynamically move slightly outward a distance D3 to enable the first cuff panel 31 sufficient clearance to facilitate movement of the wrist in the flexing mode. With this optional outward movement of the respective first and second wing panels, movement of the floating cuff is relatively free.

As shown in FIG. 11, when the glove 10 is in the flexed mode, the floating cuff 30 is oriented so that the exterior surface 31E and its respective floating cuff plane FCP, which is taken on or along the longitudinal axis LA of the glove, attains an angle α relative to the dorsal plane DP. This angle α can be optionally about 1° to about 90°, further optionally about 2° to about 45°, even further optionally about 5° to about 25°, or other angles depending on the particular amount of flexion of the wrist.

In this configuration, the exterior 31E of the first cuff portion 31 does not lay within the dorsal plane DP, and is offset relative to the same. The first and second wing panels 41 and 42, however, can generally lay in the same orientation relative to the dorsal plane DP in this flexed mode as they did in the neutral mode and extended mode. This is because these components only protect the lateral and medial sides of the wearer's wrist and/or hand and do move as a unit with the dorsal hand portion 12 and the hand portion 11 in general.

Figure 12:
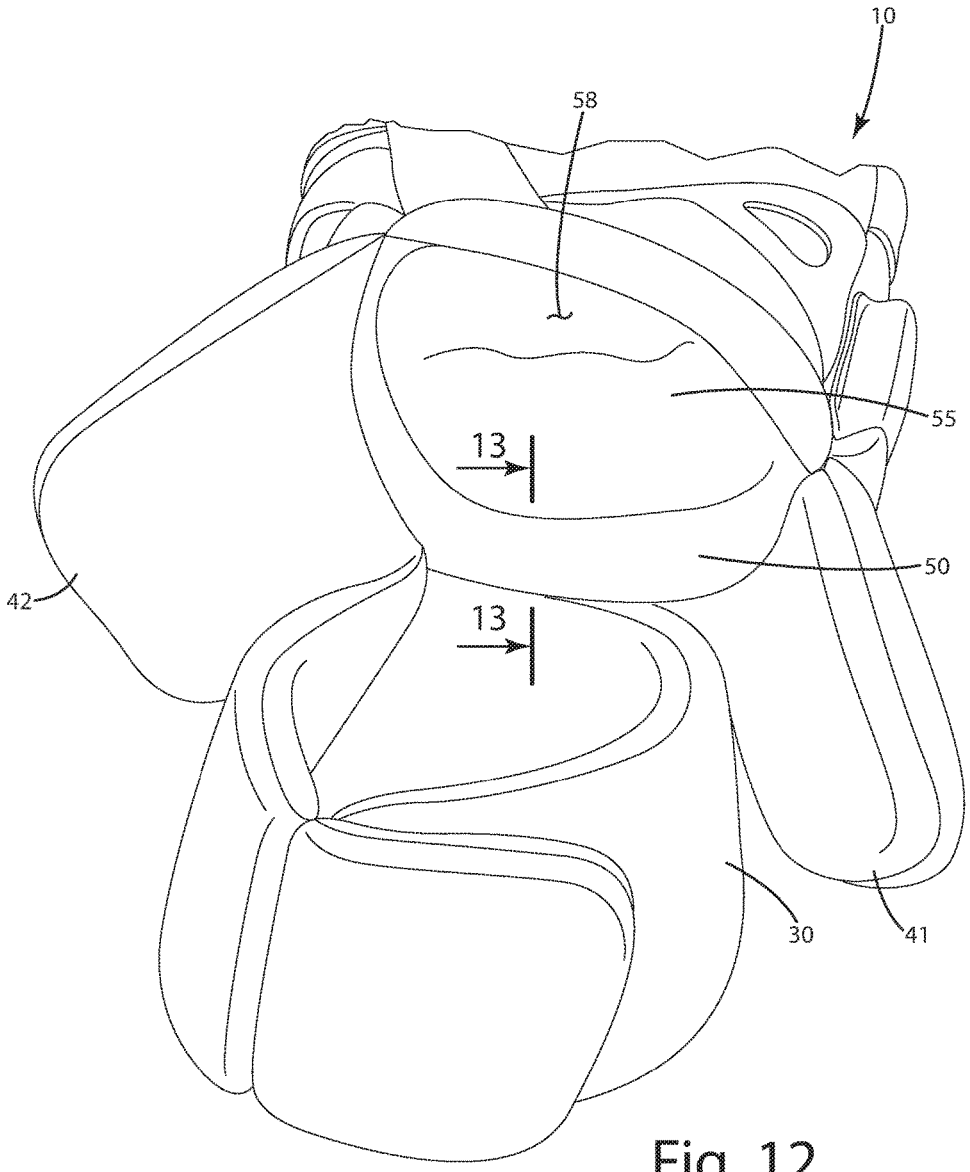
FIG. 12 is a rear perspective view of an internal wrist cuff of the glove.
Figure 13:
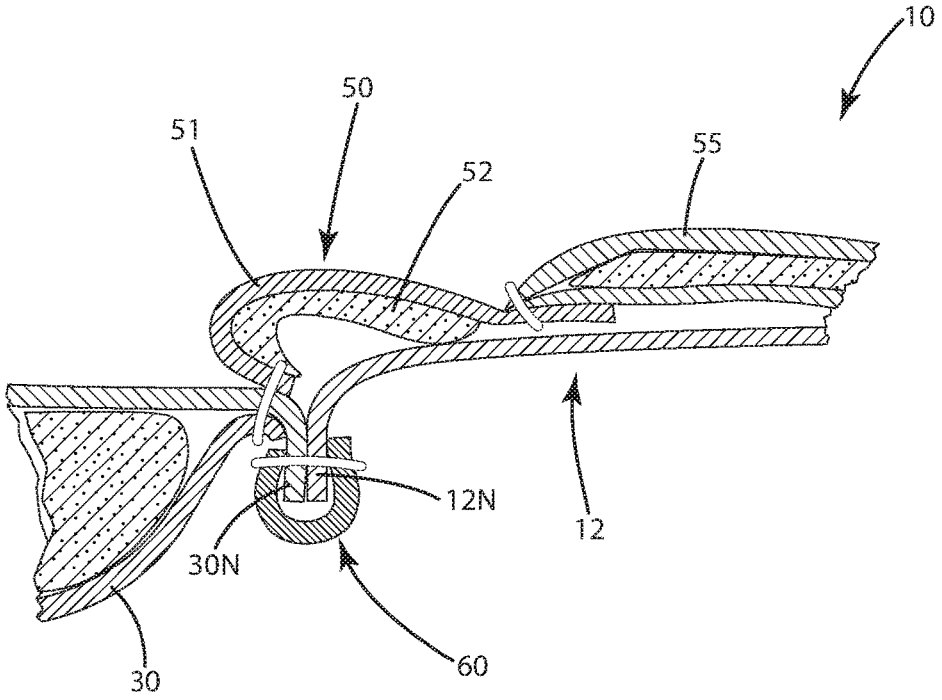
FIG. 13 is a cross section view taken along lines 13-13 of FIG. 12.

With reference to FIGS. 12 and 13, the glove 10 of the current embodiment can be outfitted with an optional internal wrist cuff 50. This wrist cuff can be attached to the dorsal hand portion 12 of the glove 10. The internal wrist cuff 50 can include a stretchable fabric 51 and/or a thin pad layer 52. The thin pad layer can be any of the above padding materials mentioned above, but generally is only about 0.1 to about 0.25 inches in thickness. This internal wrist cuff can be joined with an internal liner 55 that extends along the back hand of a wearer. The internal liner 55 and internal wrist cuff 50 can be drawn and pulled out from the interior 58 of the glove to dry and/or air out.

In this construction, the glove 10 can be void of any external conventional padded wrist cuff. Instead, the internal wrist cuff 50 can provide the desired amount of impact absorption. In some cases, the internal wrist cuff can be used in combination with a semi-rigid binding 60. This binding can include a piece of material that is wrapped, stitched, glued or otherwise fastened to abutted and/or overlapped ends 12N and 30N of the respective dorsal hand portion and/or floating cuff 30. The binding can add rigidity to the rearward surface of the dorsal hand portion. When a stick impacts that binding 60, the force can be dissipated across the width of the glove rather than at a point of contact. Further, with the internal wrist cuff on the inside of the glove, the impact is further dispersed to reduce potential for an injury to a wearer.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A protective glove comprising:

a hand portion including a hand palmar portion and an opposing hand dorsal portion, the hand portion including a lateral side and a medial side, the hand portion including a hand portion rearward edge;

a finger portion joined with and extending from the hand portion;

a thumb portion joined with and extending from the hand portion;

a first wing panel extending rearwardly from the hand portion substantially only on the lateral side, the first wing panel including a first wing panel interior edge that extends toward the hand portion rearward edge;

a second wing panel extending rearwardly from the hand portion substantially only on the medial side, the second wing panel including a second wing panel interior edge that extends toward the hand portion rearward edge; and a floating cuff joined with the hand portion, the floating cuff including a primary cuff panel, a first end, a second end, and at least one fastening element that releasably joins the first end to the second end so that the floating cuff is secured to and surrounds a wearer's wrist;

wherein the hand portion rearward edge, the first wing interior edge and the second wing interior edge cooperatively define a cuff opening, wherein the primary cuff panel is disposed within the cuff opening and is exposed through the cuff opening, wherein the primary cuff panel is adjacent the first wing interior edge and the second wing interior edge, wherein the first wing panel and second wing panel are offset from the floating cuff so that the first wing panel and the second wing panel do not cover the primary cuff panel.

2. The protective glove of claim 1, wherein the primary cuff panel includes a first cuff panel exterior surface, wherein the first wing panel includes a first wing panel exterior surface, wherein the second wing panel includes a second wing panel exterior surface, wherein the first cuff panel exterior surface is flush with both the first wing panel exterior surface and the second wing panel exterior surface.

3. The protective glove of claim 1, wherein the floating cuff is the only protective layer adapted to cover the posterior of a wearer's wrist when the glove is in a neutral mode.

4. The protective glove of claim 1, wherein the floating cuff includes a secondary cuff panel that is contiguous with the first cuff panel, wherein the secondary cuff panel forms a layer of padding under the first wing panel.

5. The protective glove of claim 1, wherein the hand dorsal portion defines a dorsal plane, wherein the primary cuff panel includes a first cuff panel exterior surface, wherein the first wing panel includes a first wing panel exterior surface, wherein the second wing panel includes a second wing panel exterior surface, wherein a first cuff panel exterior surface lies within the dorsal plane when the floating cuff is in a neutral mode, wherein a first wing panel exterior surface lies below the dorsal plane when the floating cuff is in the neutral mode, wherein a second wing panel exterior surface lies below the dorsal plane when the floating cuff is in the neutral mode.

6. The protective glove of claim 1, wherein the first wing panel is adapted to be disposed over a lateral side of a wearer's wrist, without extending over a posterior of the wearer's wrist, wherein the second wing panel is adapted to be disposed over a medial side of the wearer's wrist, without extending over a posterior of the wearer's wrist, wherein the primary cuff portion is adapted to extend over the posterior of the wearer's wrist, wherein the primary cuff portion is joined with a secondary cuff portion, wherein the secondary cuff portion is adapted to extend over the lateral side of the wearer's wrist, between the first wing panel and the lateral side of the wearer's wrist, wherein the secondary cuff portion is adapted to extend over the medial side of the wearer's wrist, between the second wing panel and the medial side of the wearer's wrist.

7. The protective glove of claim 1, wherein the floating cuff includes a secondary cuff portion joined with the primary cuff portion, wherein the primary cuff portion forms a single protective layer disposed over a posterior of a wearer's wrist, the single protective layer adapted to be the only protective layer over the posterior of the wearer's wrist, wherein the first wing panel and secondary cuff portion form a first double protective layer over a lateral side of the wearer's wrist, wherein the second wing panel and secondary cuff portion form a second double protective layer over a medial side of the wearer's wrist.

8. The protective glove of claim 1, wherein the primary cuff portion includes a primary cuff lateral edge and a primary cuff medial edge, wherein the primary cuff lateral edge abuts the first wing panel interior edge, when the glove is in a neutral mode, wherein the primary cuff medial edge abuts the second wing panel interior edge, when the glove is in a neutral mode.

9. A protective glove, comprising:

a hand portion including a rearward edge;

a finger portion joined with the hand portion;

a first wing panel extending rearward from the rearward edge;

a second wing panel extending rearward from the rearward edge, the second wing panel being distal from the first wing panel;

a floating cuff joined with the rearward edge, extending between the first wing panel and the second wing panel, the floating cuff configured to encircle a wearer's wrist, the floating cuff being the only layer of protection over a posterior of the wearer's wrist;

wherein the first wing panel defines a first wing panel interior edge and includes a first wing panel exterior, wherein the second wing panel defines a second wing panel interior edge and includes a second wing panel exterior, wherein the floating cuff extends between the first wing panel interior edge and the second wing panel interior edge, wherein the floating cuff includes a first cuff panel exterior, wherein the first wing panel exterior, the second wing panel exterior and the first cuff panel exterior are all disposed at a same level when the glove is in a neutral mode.

10. A protective glove, comprising:

a hand portion including a rearward edge;

a finger portion joined with the hand portion;

a first wing panel extending rearward from the rearward edge;

a second wing panel extending rearward from the rearward edge, the second wing panel being distal from the first wing panel;

a floating cuff joined with the rearward edge, extending between the first wing panel and the second wing panel, the floating cuff configured to encircle a wearer's wrist, the floating cuff being the only layer of protection over a posterior of the wearer's wrist;

wherein the floating cuff includes a primary cuff portion having a first cuff panel exterior, wherein the first wing panel includes a first wing panel interior, wherein the second wing panel includes a second wing panel interior, wherein the first cuff panel exterior is above the first wing panel interior and the second wing panel interior when the glove is in a neutral mode.

11. A protective glove, comprising:

a hand portion including a rearward edge;

a finger portion joined with the hand portion;

a first wing panel extending rearward from the rearward edge;

a second wing panel extending rearward from the rearward edge, the second wing panel being distal from the first wing panel;

a floating cuff joined with the rearward edge, extending between the first wing panel and the second wing panel, the floating cuff configured to encircle a wearer's wrist, the floating cuff being the only layer of protection over a posterior of the wearer's wrist;

wherein the floating cuff includes a first cuff panel exterior, wherein the first wing panel includes a first wing panel exterior, wherein the second wing panel includes a second wing panel exterior, wherein the first wing panel exterior, the second wing panel exterior and the first cuff panel exterior are all disposed at a same level when the glove is in a neutral mode.

12. A protective glove, comprising:

a hand portion;

a finger portion joined with the hand portion;

a thumb portion joined with the hand portion;

a floating cuff joined with the hand portion, the floating cuff including a first end, a second end, the first end joined with the second end so that the floating cuff is adapted to be secured to and completely surround a wearer's wrist;

wherein the floating cuff forms an uppermost protective layer covering a posterior side of a wrist of a wearer when the glove is in a neutral mode;

a first wing panel extending rearward from the hand portion;

a second wing panel extending rearward from the hand portion and distal from the first wing panel;

wherein the floating cuff includes a primary cuff portion joined with a secondary cuff portion, wherein the primary cuff portion is adapted to extend over the posterior side of the wrist of the wearer, wherein the first wing panel is adapted to be disposed over a lateral side of a wearer's wrist and over the secondary cuff portion, wherein the second wing panel is adapted to be disposed over a medial side of the wearer's wrist and over the secondary cuff portion, wherein the first and second wing panels do not extend over the primary cuff portion.

13. The protective glove of claim 12, wherein the floating cuff remains uncovered by any additional protective layer and is adapted to be disposed over the posterior side of the wrist of the wearer.

14. The protective glove of claim 12, wherein the hand portion includes a hand dorsal portion that defines a dorsal plane, wherein the floating cuff includes a first cuff panel exterior surface, wherein the first cuff panel exterior surface lies within the dorsal plane when the floating cuff is in a neutral mode.

15. The protective glove of claim 12, wherein the first wing panel lies below a dorsal plane when the floating cuff is in a neutral mode, wherein the second wing panel lies below the dorsal plane when the floating cuff is in a neutral mode.

16. A protective glove, comprising:

a hand portion;

a finger portion joined with the hand portion;

a thumb portion joined with the hand portion;

a floating cuff joined with the hand portion, the floating cuff including a first end, a second end, the first end joined with the second end so that the floating cuff is adapted to be secured to and completely surround a wearer's wrist;

wherein the floating cuff forms an uppermost protective layer covering a posterior side of a wrist of a wearer when the glove is in a neutral mode, wherein the floating cuff includes a first cuff panel exterior, wherein the first wing panel includes a first wing panel exterior, wherein the second wing panel includes a second wing panel exterior, wherein the first wing panel exterior, the second wing panel exterior and the first cuff panel exterior are all disposed at a same level when the glove is in a neutral mode.

* * * * *